US009456640B2

(12) United States Patent
Kemma et al.

(10) Patent No.: US 9,456,640 B2
(45) Date of Patent: Oct. 4, 2016

(54) SPORTSWEAR TO AID IN PELVIS SUPPORT

(75) Inventors: Kazuhiro Kemma, Oyabe (JP); Kazumi Nakada, Oyabe (JP); Yuki Tsukio, Oyabe (JP)

(73) Assignees: GOLDWIN INC., Toyama (JP); GOLDWIN TECHNICAL CENTER INC., Toyama (JP)

( * ) Notice: Subject to any disclaimer, the term of this patent is extended or adjusted under 35 U.S.C. 154(b) by 628 days.

(21) Appl. No.: 13/395,058

(22) PCT Filed: Jul. 16, 2010

(86) PCT No.: PCT/JP2010/062099

§ 371 (c)(1),
(2), (4) Date: May 29, 2012

(87) PCT Pub. No.: WO2011/030619

PCT Pub. Date: Mar. 17, 2011

(65) Prior Publication Data

US 2012/0233752 A1 Sep. 20, 2012

(30) Foreign Application Priority Data

Sep. 14, 2009 (JP) ..... 2009-212214

(51) Int. Cl.
*A41D 13/00* (2006.01)
*A41D 1/08* (2006.01)
*A41D 13/05* (2006.01)

(52) U.S. Cl.
CPC ..... *A41D 13/0015* (2013.01); *A41D 1/084* (2013.01); *A41D 13/0525* (2013.01)

(58) Field of Classification Search
CPC ..... A41D 13/0525; A41D 13/084; A41D 13/0015
USPC ..... 2/465, 22, 69
See application file for complete search history.

(56) References Cited

U.S. PATENT DOCUMENTS 3,894,542 A * 7/1975 Sacristan ..... 450/123
6,728,973 B1 * 5/2004 Webley et al. ..... 2/400

(Continued)

FOREIGN PATENT DOCUMENTS

EP 2181613 A1 5/2010
JP 7-136309 A 5/1995

(Continued)

OTHER PUBLICATIONS

International Search Report, PCT application No. PCT/JP2010/062099; dated Aug. 17, 2010, 1 page.
European Patent Application No. 10815217.4, European Search Report mailed Feb. 22, 2016, 7 pages.

*Primary Examiner* — Katherine Moran
(74) *Attorney, Agent, or Firm* — Kilpatrick Townsend and Stockton LLP

(57) ABSTRACT

The invention provides sports wear that assists in erecting the pelvis and maintaining the pelvis in an erect state.
Sports wear 1 having a pelvis supporting section 2 and an anchor section 6, wherein the pelvis supporting section 2 comprises a material with 3-6 times the tensile strength of the material of the clothing other than the pelvis supporting section 2, and holds and supports the pelvis of the wearer, the anchor section 6 is situated on the back side of the sports wear 1 and connects the pelvis supporting section 2 to a fixed part 3 on the back rise line or front rise line, and the pelvis supporting section 2 and anchor section 6 together function to prevent forward tilting of the pelvis of the wearer.

10 Claims, 4 Drawing Sheets

(56) References Cited

U.S. PATENT DOCUMENTS

| | | | | |
|---|---|---|---|---|
| 2005/0193461 | A1* | 9/2005 | Caillibotte et al. | 2/69 |
| 2006/0169004 | A1* | 8/2006 | Belluye et al. | 66/177 |
| 2007/0294803 | A1* | 12/2007 | Furgerson et al. | 2/227 |
| 2008/0201830 | A1* | 8/2008 | Ishida et al. | 2/467 |
| 2009/0007309 | A1* | 1/2009 | Yamashita et al. | 2/69 |
| 2010/0162466 | A1* | 7/2010 | Fukuyo et al. | 2/227 |

FOREIGN PATENT DOCUMENTS

| | | | |
|---|---|---|---|
| JP | 2004-107844 | A | 4/2004 |
| JP | 2004-197253 | A | 7/2004 |
| JP | 2007-31849 | A | 2/2007 |

* cited by examiner

SPORTSWEAR TO AID IN PELVIS SUPPORT

TECHNICAL FIELD

The present invention relates to sports wear having a pelvis supporting section and an anchor section. In particular, the invention relates to sports wear having a pelvis supporting section and an anchor section, which aids in erecting the pelvis and supporting an erect state of the pelvis.

BACKGROUND ART

In sports, and especially sports in which the body is intermittently or continuously kept in a forward-tilted state, it is becoming recognized that it is important to "erect the pelvis" while the upper body is being tilted forward. In bicycle racing, for example, a riding form in which the pelvis is erect with respect to the road surface is an important form for transmitting leg force to the bicycle in a prolonged and efficient manner, but it is difficult for riders, especially those with little experience, to maintain a continuous pelvis-erected posture, and with time, the upper body tends to "collapse" as the pelvis becomes inclined with respect to the road surface.

When the upper body collapses, the center of gravity is shifted forward and the body weight presses more on the arms and shoulders, producing pain on these areas, as well as on the waist and butt areas. In addition, collapse of the upper body prevents raising of the knees and interferes with efficient transmission of leg force to the bicycle, thus necessitating greater force for pedaling and potentially leading to leg pain and cramping. Therefore, researches for sports wear that can assist in erecting the pelvis and maintaining a continuous pelvis-erected posture, especially for riders with little experience are conducted.

Similarly, in sports in which a forward-tilted posture is continuously maintained, such as, motorcycling, speed skating and skiing, as well as in sports in which a forward-tilted posture is intermittently maintained, such as, tennis, using sports wear that assists in maintaining a posture that erects the pelvis itself is thought to produce an effect that allows leg force to be efficiently transmitted to the ground.

However, no sports wear designed to erect the pelvis and maintain an erect state of the pelvis has yet been disclosed, in the aforementioned fields of bicycling, motorcycling, speed skating and skiing.

As clothing that assists a forward-tilted posture, there is disclosed in PTL 1, for example, athletic wear that controls athletic posture in sports, wherein the base fabric of elastic athletic wear has a posture-controlling fabric, comprising a material with greater degree of expansion and contraction, sewn or adhesively attached to the back side of the athletic wear fabric, the posture-controlling fabric being sewn in such a manner as to pull the forward-tilted posture from the back side when a forward-tilted posture has been adopted during athletic activity, so that the forward-tilted posture is adopted more easily.

However, the athletic wear disclosed in PTL 1 pulls the forward-tilted posture from the back by a material with a high degree of expansion and contraction to maintain the forward-tilted posture, and does not focus on the pelvis and is not designed to erect the pelvis or maintain the pelvis in an erect state.

PTL 2 discloses sports wear comprising a highly restraining material and a weakly restraining material, having its main structural section formed of a stretch material and designed to be worn with its surface closely fitting to the skin of the wearer, the highly restraining material being located at positions that include the regions in contact with areas from the head of the wearer to the neck, back, lumbar, gluteal, femoral and lower leg areas, and the weakly restraining material being located in the regions other than the regions in which the highly restraining material is located.

However, the sports wear disclosed in PTL 2 serves to assist in maintaining a bent pelvic state, a bent knee state and a raised head state in the forward-tilted posture, by positioning the highly restraining material at the different locations, whereas it does not focus on the pelvis and is not designed to erect the pelvis or maintain the pelvis in an erect state.

As clothing designed to support the lumbar region, PTL 3 discloses exercising leggings having the main structural section formed of a stretch material, being worn in a closely fitting state with the surface of the lower body of the wearer, and comprising a first type of material and a second type of material, wherein the restraining force of the first type of material is stronger than the restraining force of the second type of material, the first type of material being located at positions that cover all or a portion of at least both gluteus maximus muscles, and the second type of material being located at the regions other than the regions in which the first type of material is located.

However, the exercising leggings disclosed in PTL 3 assist in contraction of the femoral muscles, and this invention is not focused on the pelvis and is not designed to erect the pelvis or maintain the pelvis in an erect state.

Also, PTL 4 discloses a garment comprising a stretch fabric wherein the garment covers at least a part of the lower body of a wearer, has a crotch part, and is worn by being fitted to the wearer's body, wherein: the garment in part has a portion with a strong straining force; the portion with a strong straining force is a strong straining portion; right and left parts of the portion are connected at a position on the back side of the garment corresponding to any region from os sacrum to vertebrae lumbalis of the wearer's body; and the portion covers a region extending from the position through tops of bulges of the buttocks or vicinities thereof approximately in the direction of muscle fibers of musculus gluteus maximus at right and left to at least the vicinity of trochanter major.

However, the garment disclosed in PTL 4 improves stability of the hip joint, and this invention is not focused on the pelvis and is not designed to erect the pelvis or maintain the pelvis in an erect state.

CITATION LIST

Patent Literature

PTL 1 Japanese Unexamined Patent Publication No. 2007-16366

PTL 2 Japanese Unexamined Patent Publication No. 2006-97213

PTL 3 Japanese Unexamined Patent Publication No. 2005-146450

PTL 4 Japanese Unexamined Patent Publication No. 2001-192903

SUMMARY OF INVENTION

Technical Problem

As explained above, conventional sports wear has not been designed with focus on the pelvis, and such clothing has not assisted in erecting the pelvis or maintaining the pelvis in an erect state.

It is therefore an object of the present invention to provide sports wear that assists in erecting the pelvis and maintaining the pelvis in an erect state.

Solution to Problem

As a result of diligent research directed toward solving the problems described above, the present inventors have found that the problems mentioned above can be solved by sports wear having a pelvis supporting section and an anchor section, wherein the pelvis supporting section comprises a material with 3-6 times the tensile strength of the material of the clothing other than the pelvis supporting section, and holds and supports the pelvis of the wearer, the anchor section is situated on the back side of the sports wear and connects the pelvis supporting section to a fixed part on the back rise line or front rise line, and the pelvis supporting section and anchor section together function to prevent forward tilting of the pelvis of the wearer.

Specifically, the present invention relates to the following aspects.

[Aspect 1]

Sports wear having a pelvis supporting section and an anchor section, wherein the pelvis supporting section comprises a material with 3-6 times the tensile strength of the material of the clothing other than the pelvis supporting section, and holds and supports the pelvis of the wearer, the anchor section is situated on the back side of the sports wear and connects the pelvis supporting section to a fixed part on the back rise line or front rise line, and the pelvis supporting section and anchor section together function to prevent forward tilting of the pelvis of the wearer.

[Aspect 2]

Sports wear according to aspect 1, wherein the pelvis supporting section has a shape that covers the sacrum of the wearer and hugs the left and right anterior superior iliac spines.

[Aspect 3]

Sports wear according to aspect 2, wherein the pelvis supporting section has a shape that also holds and supports the lumbar vertebrae of the wearer.

[Aspect 4]

Sports wear according to any one of aspects 1 to 3, wherein the pelvis supporting section has a shape that does not cover the abdominal region.

[Aspect 5]

Sports wear according to any one of aspects 1 to 4, wherein the anchor section is situated along the back rise line.

[Aspect 6]

Sports wear according to any one of aspects 1 to 5, wherein the anchor section is provided utilizing a seam on the back rise line.

[Aspect 7]

Sports wear according to any one of aspects 1 to 6, wherein the anchor section is formed by sewing the material other than the pelvis supporting sections with stay tape or a non-elongating material.

[Aspect 8]

Sports wear according to any one of aspects 1 to 7, wherein the pelvis supporting section has a multilayer structure comprising a plurality of fabric layers and one or more hot-melt layers.

[Aspect 9]

Sports wear according to any one of aspects 1 to 8, wherein the sports wear is bicycling clothing.

[Aspect 10]

Sports wear according to aspect 9, wherein the fixed part is at the section of crossing between the back rise line and the edge of a hip pad section comprising a pad material that softens impact on the crotch section.

[Aspect 11]

Sports wear according to any one of aspects 1 to 8, wherein the sports wear is skating clothing or skiing clothing.

[Aspect 12]

Sports wear according to aspect 9 or 11, wherein the fixed part is the crotch cross.

Advantageous Effects of Invention

The sports wear of the invention can assist in erecting the pelvis and maintaining the pelvis in an erect state.

DESCRIPTION OF EMBODIMENTS

Figure 1:
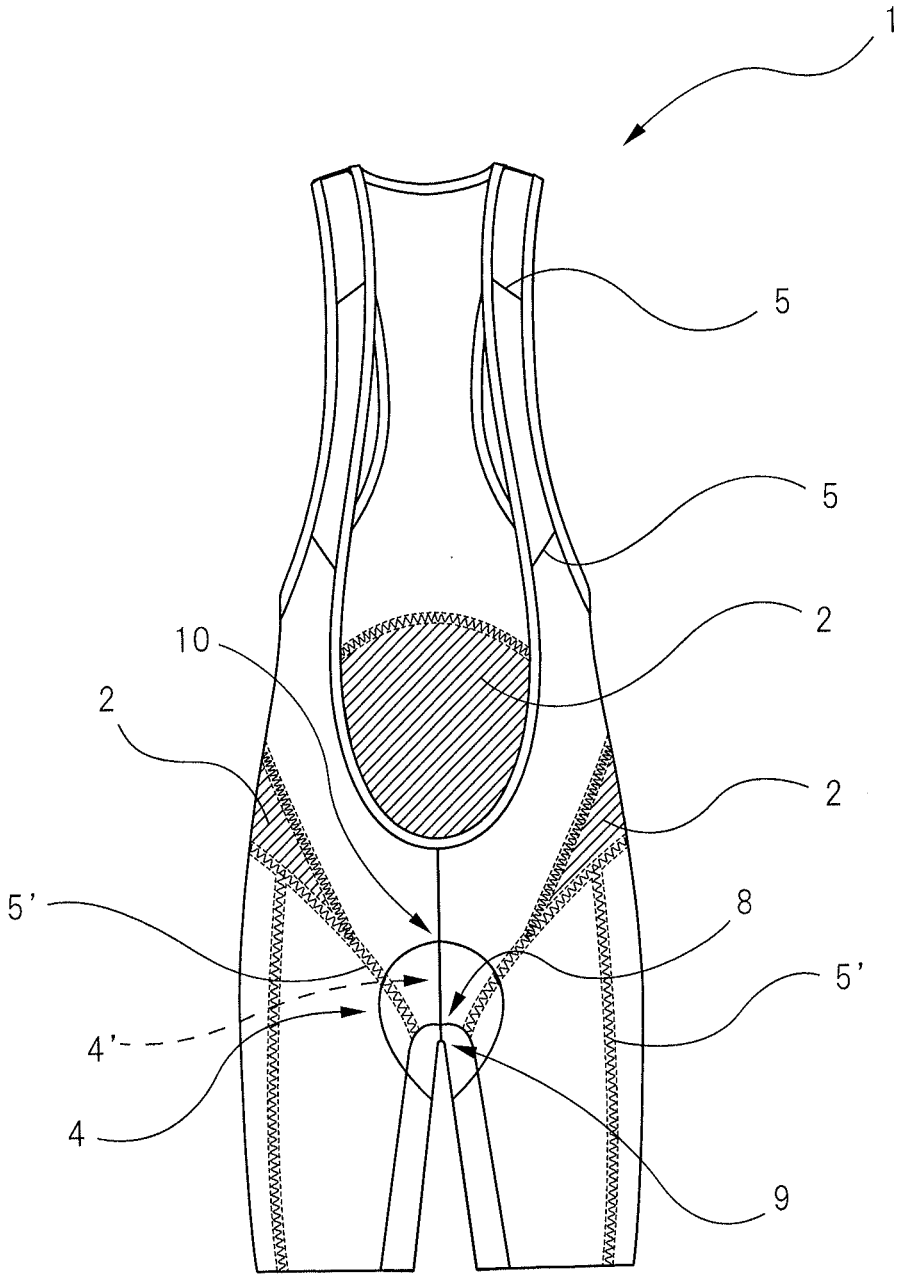
FIG. 1 is a front view showing an embodiment of the sports wear of the invention.

The sports wear of the invention will now be described in greater detail.

[Pelvis Supporting Section]

As used herein, the "pelvis supporting section" is the section that holds and supports the pelvis of the wearer, and which assists in erecting the pelvis and maintaining the pelvis in an erect state even when the wearer adopts a forward-tilted posture for the body as a whole, so that the pelvis does not collapse together with it.

The pelvis supporting section, together with the anchor section described hereunder, functions to prevent forward tilting of the pelvis of the wearer.

As used herein, "pelvis" includes the hip bone, sacrum and coccygeal bone, where "hip bone" includes the sections originating from the iliac bone, ischial bone and pubic bones, irrespective of their degree of fusion. Therefore, when the term "iliac bone" is used, for example, it includes the iliac bone and the portions of the hip bone originating from the iliac bone.

The object for erecting the pelvis is the surface to which force is to be transmitted, which is, for example, a road surface in the case of clothing for two-wheel vehicles, such as, bicycle clothing or motorcycle clothing, a skating rink surface in the case of skate clothing, or a slanted surface in the case of ski clothing.

The pelvis supporting section comprises a material with 3-6 times the tensile strength compared to the material of the sections of the sports wear other than the pelvis supporting section, and it preferably comprises a material with 3.5-5.5 times the tensile strength and more preferably comprises a material with 4-5 times the tensile strength. If the tensile strength of the material is less than 3-fold it will be difficult to obtain an effect of holding and supporting the pelvis, while if the tensile strength of the material is greater than 6-fold, the feel during wear will be less comfortable.

As used herein, "material of the sections of the sports wear other than the pelvis supporting section" means any part of the material other than the pelvis supporting section, and particularly this includes material from the upper body section adjacent to the pelvis supporting section, and material from the lower body section adjacent to the pelvis supporting section.

The tensile strength can be measured according to method B (grab method) of JIS L 1018, "8.13 Tensile strength and elongation percentage". The method used differs from JIS L 1018 in the following aspects.

Grip spacing: 10 cm

Pull rate: 100 mm/min

Measurement: Stretching 5 times to an elongation percentage of 50%, recording the 5th measured value.

The measuring instrument used was a constant-extension-rate tensile tester, such as, an RTC-1210A by Orien Tec.

The tensile strength used may be the value at 30% elongation. This is based on the assumption that the pelvis supporting section is generally stretched by about 30% when worn.

The shape of the pelvis supporting section is not particularly restricted as long as it is within the range of shapes that can hold and support the pelvis of the wearer. The pelvis supporting section preferably has a shape that hugs at least a portion of each of the right and left iliac bones of the wearer. The pelvis supporting section more preferably has a shape that covers the sacrum of the wearer and hugs the left and right anterior superior iliac spines.

The pelvis supporting section may also have a shape such that the top edge of the back side extends to cover the lumbar vertebrae of the wearer while also holding and supporting the lumbar vertebrae of the wearer. Holding and supporting the lumbar vertebrae can reduce compression of the sciatic nerve during movement. Also, the bottom edge of the back side of the pelvis supporting section may cover the coccygeal bone.

In addition, the front side of the pelvis supporting section preferably has a shape that leaves at least a portion of the abdominal region uncovered, and more preferably it has a shape that leaves the hypogastric region uncovered. By releasing at least a portion of the abdominal region, and especially the hypogastric region, it is possible to reduce the sense of pressure on the abdominal region which is undesirable during sports.

As used herein, the term "abdominal region" refers to the region between the thorax and the groin, and "hypogastric region" refers to the region of the abdominal region below the navel.

The material of the pelvis supporting section is not particularly restricted as long as it can provide the tensile strength mentioned above. The material of the pelvis supporting section may be, for example, any of various fabrics commonly used in the field of sports wear, either alone or in multiple layers. Examples of such fabrics include knitted fabrics, including regular knits, such as, tricot knits, and woven fabrics. The fiber used for the fabric may be, for example, a polyurethane-based fiber with excellent elasticity.

The material of the pelvis supporting section may have a hot-melt layer sandwiched by 2 such fabric layers, or it may have a polymer layer attached to the surface of the fabric.

In order to impart desired properties, and particularly tensile strength, to the pelvis supporting section, the material of the pelvis supporting section may include a polymer film capable of imparting such properties. Examples of such polymer films include polyurethane, polyester and acryl, for example, ethylene and vinyl acetate copolymers, polyolefins, polyamides, synthetic rubber and the like.

As used herein, "hot-melt layer" refers to a layer of a hot-melt adhesive that adhesively bonds 2 layers by melting under heat, followed by cooling. The hot-melt adhesive is not particularly restricted, and examples include polyurethane, polyester and acryl, for example, ethylene and vinyl acetate copolymers, polyolefins, polyamides, synthetic rubber and the like.

As used herein, "polymer layer" refers to a layer of a polymer adhesively bonded to one layer. The polymer layer and hot-melt layer differ in that the polymer layer is adhesively bonded only to one layer while the hot-melt layer is adhesively bonded to 2 layers. The polymer for the polymer layer is not particularly restricted, and similar to the hot-melt adhesive, examples include polyurethane, polyester and acryl, for example, ethylene and vinyl acetate copolymers, polyolefins, polyamides, synthetic rubber and the like.

The material of the pelvis supporting section preferably has a high elastic recovery rate, which is the speed at which it returns to its original state after stretching. Since a wearer performs a variety of different movements during sports, the diameters of the waist and gluteal regions, for example, intermittently undergo considerable variation during movement. Thus, a high elastic recovery rate allows the variation in waist and gluteal region diameters to be rapidly followed under such conditions, thereby allowing the pelvis of the wearer to be satisfactorily held and supported.

[Fixed Part]

The fixed part is the section to which the anchor section, described hereunder, is connected, and it is on the back rise line or front rise line. As used herein, "front rise line" refers to a line on the front side of the sports wear, running from the crotch placket end through the right/left center section of the clothing in the height direction, to no higher than the waist section, and "back rise line" refers to a line on the back side of the sports wear, running from the crotch placket end through the right/left center section of the clothing in the height direction, to the pelvis supporting section.

As used herein, "front side" refers to the ventral side, and "back side" refers to the dorsal side.

The position of the fixed part is not particularly restricted as long as it is on the back rise line or front rise line, and it may be, for example, on the crotch placket end or crotch cross. When the sports wear is bicycling clothing, and when it also has a hip pad section comprising a pad material that softens impacts on the crotch section, the fixed part may be the section where the edge of the hip pad section crosses the back rise line, or the section where the edge of the hip pad section crosses the front rise line. The fixed part may also be within the hip pad section, instead of at the edge of the hip pad section.

As used herein, "crotch cross" refers to the section where the back rise line or front rise line crosses with the section connecting the front and back parts of the leg region, and "crotch placket end" refers to the sections of the back rise line and front rise line located at the lowest point when worn, as the sections connecting the back rise line and front rise line.

When the fixed part is the crotch placket end or crotch cross, the fixed part will be located near the base of the right and left leg regions, and therefore its location will not easily vary when worn.

When the fixed part is the crotch placket end or crotch cross, the fixed part will generally consist of at least 2 parts, a right leg part and a left leg part, and more generally they are sections where 4 parts, namely the front body parts of the left and right leg regions (total: 2) and the back body parts of the left and right leg regions (total: 2), are connected by sewing or adhesive attachment, and therefore they are resistant to elongation and undergo little positional variation.

Also, when the sports wear is bicycling clothing, the fixed part will be the site which is pressed by the wearer and the saddle, and will therefore undergo little variation from this viewpoint as well.

When the sports wear is bicycling clothing and has a hip pad section, the hip pad section, being at a location which is pressed by the wearer and saddle, as well as the fixed part which is the section where the edge of the hip pad section crosses the back rise line, or the section where the edge of the hip pad section crosses the front rise line, will also undergo little positional variation.

[Anchor Section]

The anchor section used for the invention is situated on the back side of the clothing, and it is the section connecting the pelvis supporting section to the fixed part on the back rise line or front rise line.

The anchor section, together with the pelvis supporting section described above, functions to prevent forward tilting of the pelvis of the wearer.

Figure 4:
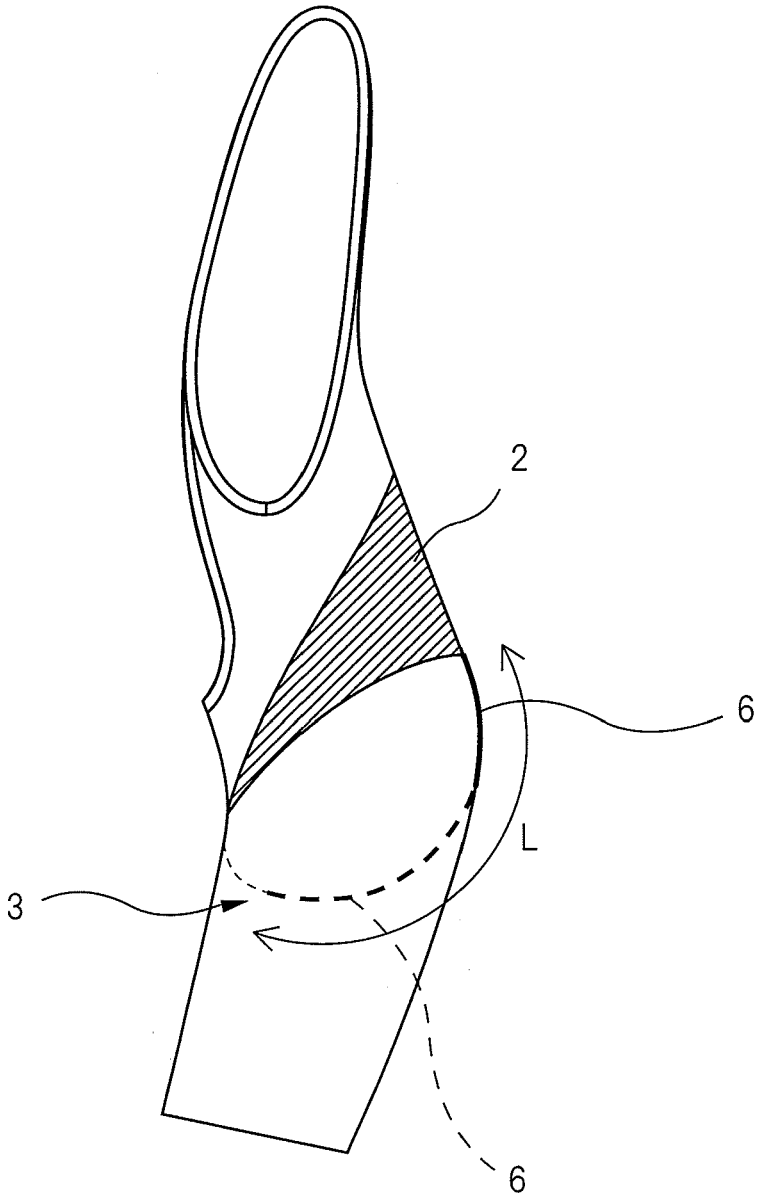
FIG. 4 is a diagram illustrating the function of the anchor section used for the invention.

The function of the anchor section used for an embodiment of the invention will now be explained with reference to FIG. 4. FIG. 4 is a left side view of sports wear in accordance with an embodiment of the invention. The anchor section 6 is connected to the pelvis supporting section 2 and to the fixed part 3, which is the crotch cross. With normal posture which is, in the case of athletic bicycling for example, a posture straddling the bicycle without holding the handlebar, the length of the anchor section 6 is a reference length L.

When the handlebar is gripped and the pelvis is erect even in a forward-tilted posture, there is virtually no change in the position of the fixed part 3 and pelvis supporting section 2, and the length of the anchor section 6 is approximately equal to the reference length L.

However, when the handlebar is gripped and the pelvis becomes collapsed (the upper body has collapsed), the position of the fixed part 3 is virtually unchanged but the pelvis supporting section 2 collapses forward together with the upper body (toward the left in FIG. 4), and the length of the anchor section 6 is increased over the reference length L.

Consequently, if a material that does not stretch or is resistant to stretching in the load range expected during movement is used for the anchor section 6, it should be possible to prevent the pelvis from becoming collapsed.

The position of the anchor section is not particularly restricted as long as it is in a region located on the back side of the sports wear, and can connect the pelvis supporting section to the fixed part on the back rise line or front rise line.

The anchor section is preferably located along the back rise line. This will connect the pelvis supporting section along the extension line of the back of the wearer, thus helping to minimize rocking of the body in the right/left directions.

When the material at the lower body region adjacent to the pelvis supporting section on the back side of the sports wear is separated into at least 2 parts along the back rise line, the anchor section may be provided with a joint, such as, a seam section or adhesive section, on the back rise line. For example, the anchor section may be produced by using a material with desired mechanical properties, such as, excellent strength, for the seam composing a seam section, by using a material with desired mechanical properties as an adhesive for an adhesive section, or by placing a separate member with desired mechanical properties between the 2 parts and stitching or adhesively attaching the member to the 2 parts.

The material of the anchor section is not particularly restricted as long as it can connect the pelvis supporting section with the fixed part on the back rise line or front rise line, and for example, it may be simply sewn onto a material other than that of the pelvis supporting section. The sewn section formed by sewing may be a flat seam, for example. When the anchor section is to be formed by sewing, the material other than that of the pelvis supporting section may be sewn together with stay tape to modify the mechanical properties, such as, strength and elongation, of the anchor section.

Cotton tape is an example of such stay tape.

The anchor section may be composed of the same material as that of the pelvis supporting section, as long as it can connect the pelvis supporting section to the fixed part. The anchor section may also be integrated with the pelvis supporting section.

[Sports Wear]

Figure 2:
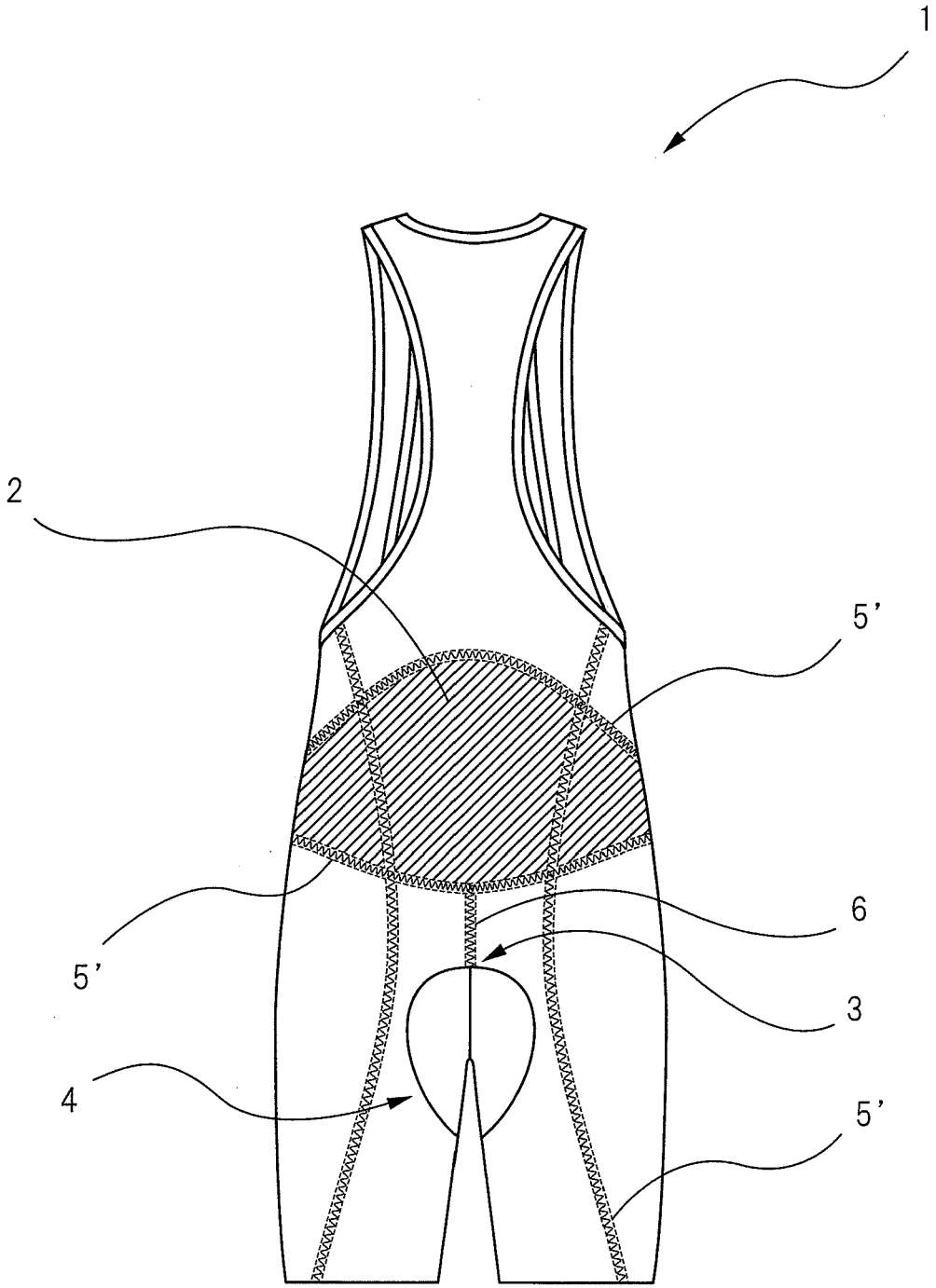
FIG. 2 is a rear view showing an embodiment of the sports wear of the invention.

An embodiment of the sports wear of the invention is shown in FIG. 1 and FIG. 2. FIG. 1 is a front view showing an embodiment of the sports wear of the invention. FIG. 2 is a rear view showing an embodiment of the sports wear of the invention. FIG. 1 and FIG. 2 are examples of bicycling clothing. In the sports wear 1 shown in FIG. 1 and FIG. 2, the pelvis supporting section 2 has a shape covering the sacrum of the wearer and hugging the left and right anterior superior iliac spines, and it extends so that the top edge of the back side covers the lumbar vertebrae of the wearer. The fixed part 3 is the section where the edge of the hip pad section 4 crosses the back rise line. The anchor section 6 is formed by sewing a material other than that of the pelvis supporting section together with stay tape, so that it has a seam, such as, a flat seam, and it connects the pelvis supporting section 2 and the fixed part 3. The numeral 5 denotes the sewn section, and the numeral 5' denotes the flat seam. In FIG. 1 and FIG. 2, the numerals 8, 9 and 10 denote the crotch cross, crotch placket end and the crossing section between the hip pad section edge and front rise line, respectively.

Figure 3:
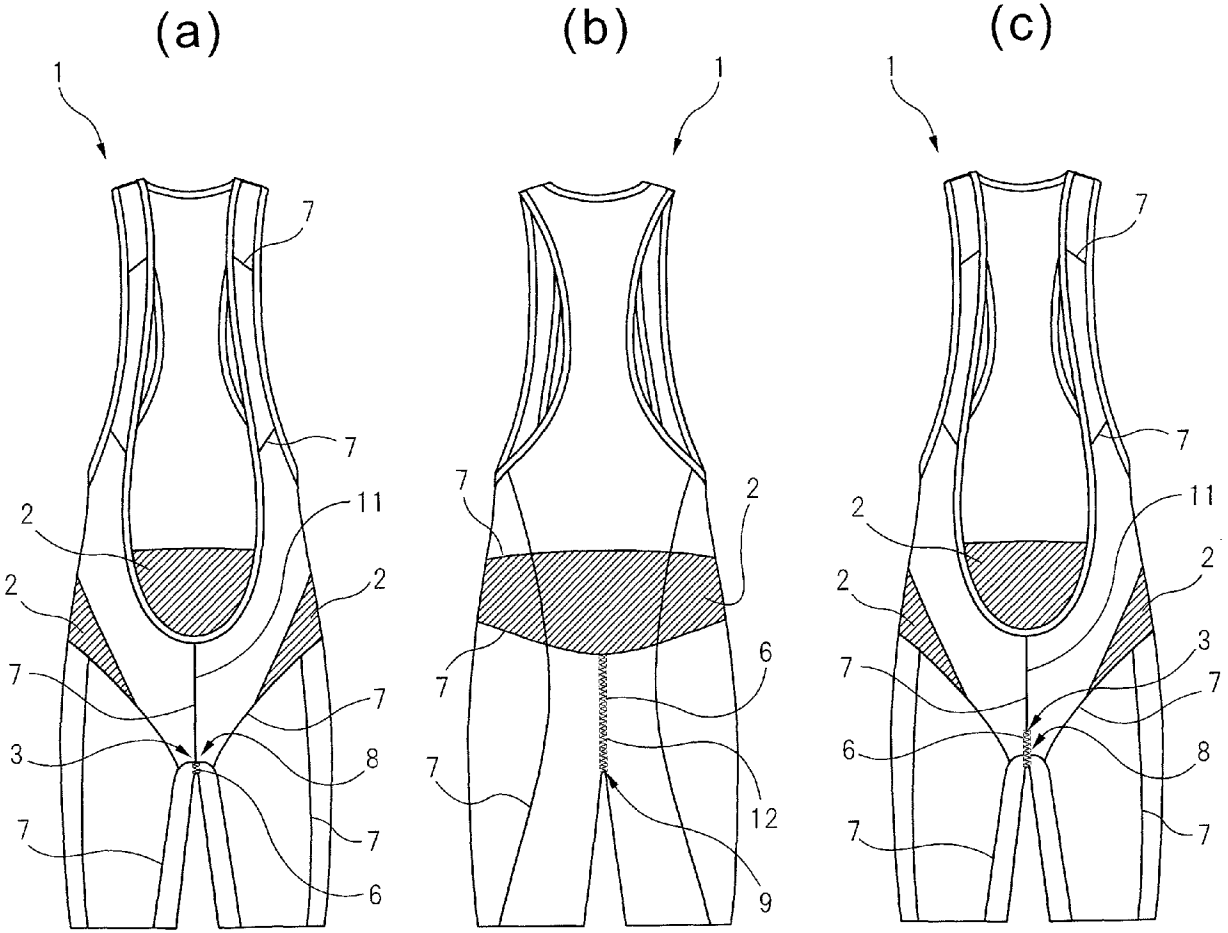
FIG. 3 shows a variation example of the sports wear of the invention.

FIG. 3 shows a variation example of the sports wear of the invention. FIG. 3 is a front view, and FIG. 3 is a rear view, and FIG. 3 is a front view. In the sports wear 1 shown in FIG. 3, the pelvis supporting section 2 has a shape that covers the sacrum of the wearer and hugs the left and right anterior superior iliac spines. The anchor section 6 is formed by sewing the same material as that of the pelvis supporting section so that it has a seam, such as, a flat seam, and it connects the pelvis supporting section 2 to the crotch cross 8, which is the fixed part 3. The adhesive sections 7 bond each of the materials with an adhesive. In FIG. 3, the numerals 11 and 12 denote the front rise line and the back rise line, respectively.

The material other than that of the pelvis supporting section of the sports wear may be a material commonly used in the field of sports wear, such as, a fabric, for example a knitted fabric, such as, a regular knit, for example, a tricot, or a woven fabric, without any particular restrictions. A portion of the fabric may also be replaced with a mesh in consideration of air permeability. The material other than that of the pelvis supporting section may also consist of a layering of multiple fabrics, and if necessary, a hot-melt layer or polymer layer may be included at any position between the fabric.

The sports wear may be used in general sports in which it is desirable to have the pelvis maintained erect while in a forward-tilted posture, and examples of sports wear according to the invention include clothing for two-wheel vehicles, such as, bicycling clothing and motorcycling clothing, as well as skating clothing, skiing clothing and tennis clothing.

EXAMPLES

The invention will now be explained in greater detail using examples and comparative examples, with the understanding that the invention is in no way limited by the examples.

Production Example 1

The bicycling clothing 1 shown in FIG. 1 and FIG. 2 was produced. The pelvis supporting section had a tricot fabric/hot-melt layer/tricot fabric multilayer structure, and the material for the sections other than the pelvis supporting section was the same tricot fabric as the pelvis supporting section. The anchor section was sewn to stay tape with the tricot fabric by a flat seam, and the pelvis supporting section was connected to the section where the hip pad section edge and the back rise line crossed, as a fixed part. Upon measuring the tensile strength by the method of JIS L 1018, mentioned above, the pelvis supporting section at 30% elongation had a tensile strength of 5 times that of the tricot fabric at the lower body adjacent to the pelvis supporting section.

Example 1

The bicycling clothing 1 was worn by several athletic riders, and the obtained responses indicated that the pelvis was erected more easily than with conventional bicycling clothing, and that the erect state of the pelvis was easier to maintain, especially with prolonged riding.

REFERENCES SIGNS LIST

1 Sports wear
2 Pelvis supporting section
3 Fixed part
4 Hip pad section
4' Hip pad material
5 Sewn section
5' Flat seam
6 Anchor section
7 Adhesive section
8 Crotch cross
9 Crotch placket end
10 Section where hip pad section edge crosses front rise line
11 Front rise line
12 Back rise line

The invention claimed is:

1. Sports wear comprising a pelvis supporting section made of a first material for supporting a pelvis, an upper body section made of a second material adjacent to the pelvis supporting section, wherein the first material of the pelvis supporting section has a tensile strength of 3.5 to 6 times the tensile strength of the second material of the upper body section, a fixed part located under the pelvis supporting section on a back rise line or a front rise line, wherein the back rise line runs in a longitudinal direction through a right/left midline of the sports wear on a back side of the sports wear from a crotch placket end to the pelvis supporting section, and the front rise line runs in the longitudinal direction through the right/left midline of the sports wear on a front side of the sports wear from the crotch placket end to the pelvis supporting section, and an anchor section made of a non-elongating material, and sewn along the back rise line to connect the pelvis supporting section to the fixed part on the back rise line or sewn along the back rise line and the front rise line to connect the pelvis supporting section to the fixed part on the front rise line, wherein the pelvis supporting section and anchor section together function to prevent forward tilting of the wearer's pelvis.

2. Sports wear according to claim 1, wherein the pelvis supporting section when worn covers the wearer's sacrum and hugs the wearer's left and right anterior superior iliac spines.

3. Sports wear according to claim 2, wherein the pelvis supporting section when worn holds and supports the wearer's lumbar vertebrae.

4. Sports wear according to claim 1, wherein the pelvis supporting section when worn does not cover the wearer's abdominal region.

5. Sports wear according to claim 1, wherein the non-elongating material of the anchor section is a stay tape.

6. Sports wear according to claim 1, wherein the pelvis supporting section has a multilayer structure comprising a plurality of fabric layers and one or more hot-melt layers.

7. Sports wear according to claim 1, wherein the sports wear is bicycling clothing.

8. Sports wear according to claim 7, wherein the fixed part is at a point of crossing between the back rise line and an edge of a hip pad section comprising a pad material that softens impact on a crotch section.

9. Sports wear according to claim 1, wherein the sports wear is skating clothing or skiing clothing.

10. Sports wear according to claim 1, wherein the fixed part is a crotch cross.

* * * * *